US009267360B2

(12) United States Patent
Krush et al.

(10) Patent No.: US 9,267,360 B2
(45) Date of Patent: Feb. 23, 2016

(54) PREMIUM MESH SCREEN

(75) Inventors: Robert Krush, Sugar Land, TX (US); Terje Moen, Sandnes (NO); Min Mark Yuan, Katy, TX (US); Arnold Gene Marsh, Pearland, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 288 days.

(21) Appl. No.: 13/431,720

(22) Filed: Mar. 27, 2012

(65) Prior Publication Data

US 2012/0298223 A1 Nov. 29, 2012

Related U.S. Application Data

(60) Provisional application No. 61/470,830, filed on Apr. 1, 2011, provisional application No. 61/506,941, filed on Jul. 12, 2011.

(51) Int. Cl.
*E21B 43/08* (2006.01)

(52) U.S. Cl.
CPC ..... *E21B 43/08* (2013.01); *Y10T 137/794* (2015.04)

(58) Field of Classification Search
USPC ..... 166/230, 227, 278, 56, 231
See application file for complete search history.

(56) References Cited

U.S. PATENT DOCUMENTS

| | | | |
|---|---|---|---|
| 5,404,954 | A | 4/1995 | Whitebay et al. |
| 5,411,084 | A | 5/1995 | Padden |
| 5,611,399 | A | 3/1997 | Richard et al. |
| 5,624,560 | A | 4/1997 | Voll et al. |
| 5,782,299 | A | 7/1998 | Simone et al. |
| 5,823,260 | A | 10/1998 | McConnell et al. |
| 5,849,188 | A | 12/1998 | Voll et al. |
| 5,899,271 | A | 5/1999 | Simone et al. |
| 6,092,604 | A | 7/2000 | Rice et al. |
| 6,109,349 | A | 8/2000 | Simone et al. |
| 6,158,507 | A | 12/2000 | Rouse et al. |
| 6,305,468 | B1 | 10/2001 | Broome et al. |
| 6,478,092 | B2 | 11/2002 | Voll et al. |
| 6,514,408 | B1 | 2/2003 | Simone |
| 6,607,032 | B2 | 8/2003 | Voll et al. |
| 6,619,401 | B2 | 9/2003 | Echols et al. |
| 6,675,901 | B2 | 1/2004 | Johnson et al. |
| 6,679,334 | B2 | 1/2004 | Johnson et al. |
| 6,715,544 | B2 | 4/2004 | Gillespie et al. |
| 7,497,257 | B2 | 3/2009 | Hopkins et al. |
| 7,578,344 | B2 | 8/2009 | Hopkins et al. |
| 7,588,079 | B2 | 9/2009 | Kluger et al. |
| 2005/0086807 | A1 | 4/2005 | Richard et al. |

(Continued)

FOREIGN PATENT DOCUMENTS

| | | |
|---|---|---|
| WO | 2009108128 | 9/2009 |

*Primary Examiner* — Taras P Bemko
(74) *Attorney, Agent, or Firm* — Patrick A. Traister; Jeffery Peterson

(57) ABSTRACT

Systems and methods for preventing particles from flowing into a base pipe are provided. A base pipe can have a plurality of perforations formed radially therethrough. A filtering strip can be wrapped helically around an outer surface of the base pipe to cover at least a portion of the perforations. The filtering strip can include a drainage layer, a filter layer, and a shroud layer. The drainage layer can include a plurality of ribs in contact with the outer surface of the base pipe. The filter layer can be coupled to the drainage layer and include at least one mesh screen. The shroud layer can be coupled to the filter layer and include a perforated metal sheet.

24 Claims, 3 Drawing Sheets

(56) References Cited

U.S. PATENT DOCUMENTS

| | | | | |
|---|---|---|---|---|
| 2005/0269256 | A1* | 12/2005 | Haq et al. | 210/490 |
| 2008/0023393 | A1* | 1/2008 | Blackburne, Jr. | 210/455 |
| 2010/0000742 | A1 | 1/2010 | Bonner | |
| 2010/0122810 | A1 | 5/2010 | Langlais | |
| 2010/0258300 | A1 | 10/2010 | Shoemate | |

* cited by examiner

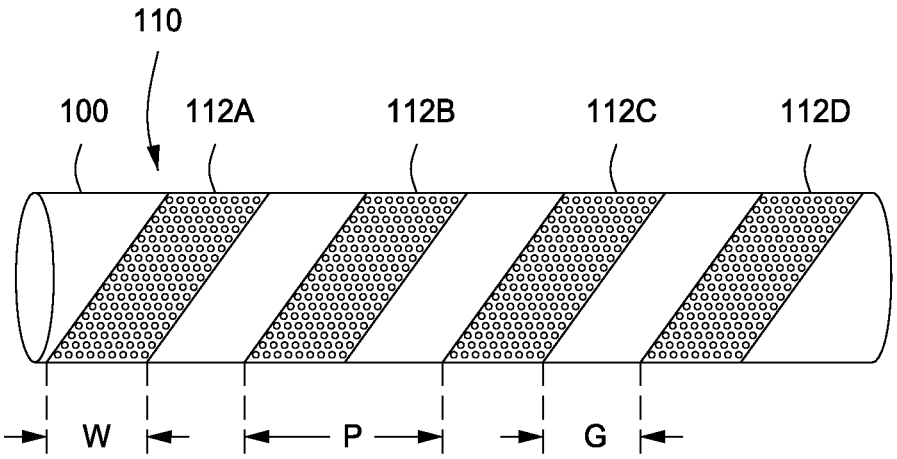
FIG. 1
FIG. 2
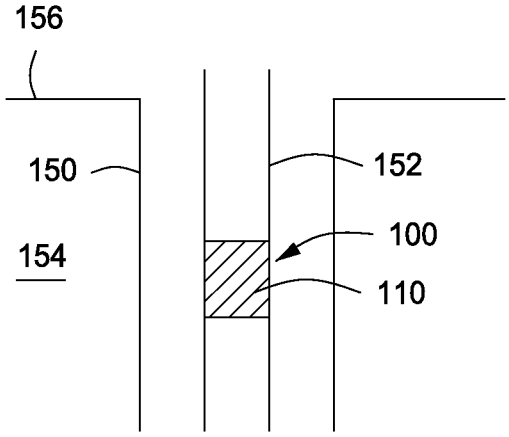
FIG. 3
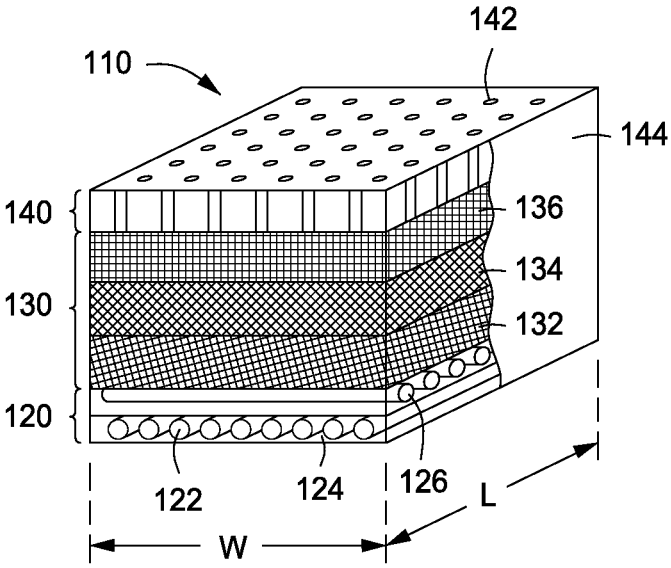

FIG. 4
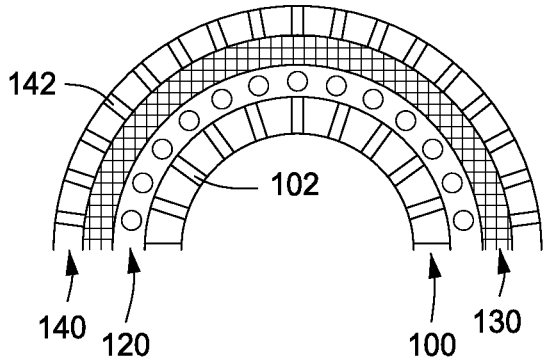
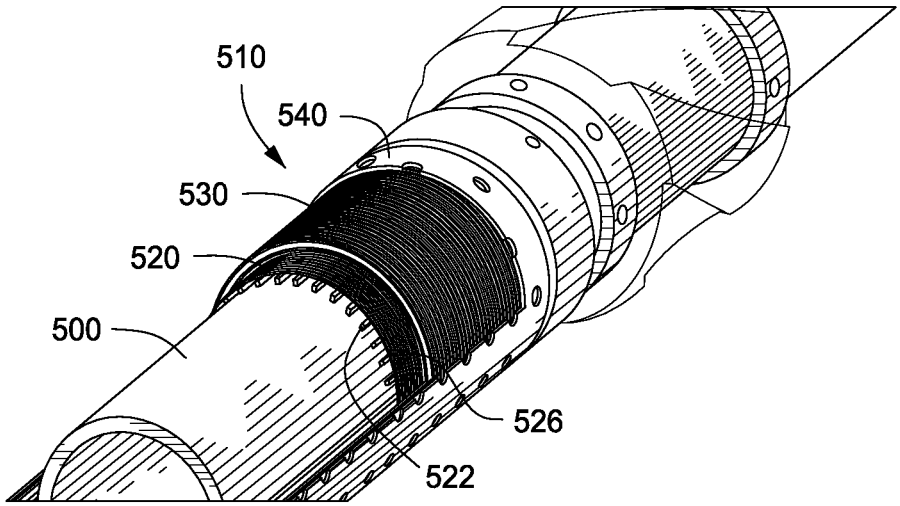
FIG. 5
FIG. 6
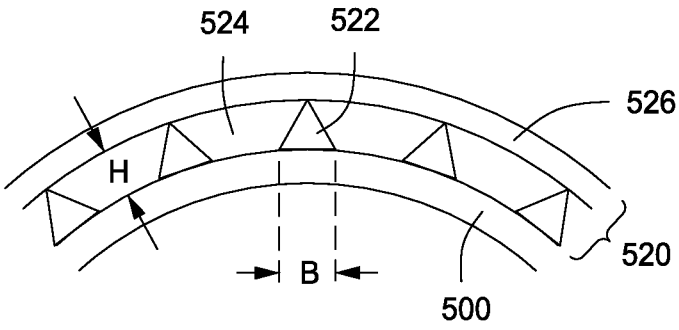

PREMIUM MESH SCREEN

CROSS-REFERENCE TO RELATED APPLICATIONS

This application claims the benefit of and priority to U.S. provisional patent application having Ser. No. 61/470,830 that was filed on Apr. 1, 2011, and U.S. provisional patent application having Ser. No. 61/506,941 that was filed on Jul. 12, 2011. The entirety of each application is incorporated by reference herein in its entirety.

BACKGROUND

Embodiments described herein generally relate to filtering screens for downhole tools. More particularly, embodiments described herein generally relate to screens used to filter particulates out of oil or gas as it is being drawn into a base pipe from a well.

Conventional wells include a tube or string to extract oil or gas from the well. The string generally includes a plurality of joint assemblies positioned along the string in the oil or gas bearing portions of the formation being drilled. A joint assembly typically includes a perforated base pipe through which the oil or gas can flow. As such, the oil or gas enters the string through the perforations and flows up to the surface. It is desirable to filter the oil or gas before it enters the string and flows up to the surface. Thus, one or more screen assemblies oftentimes cover the perforations to filter particulates in the oil or gas.

Screen assemblies are typically a tubular jacket that slides axially into place over the perforated base pipe. Screen assemblies are manufactured in a variety of sizes. For example, screen assemblies are manufactured to slide onto base pipes having diameters of 2.375", 2.875", 3.5", 4", 4.5", 5", 5.5", and 6.625". Moreover, screen assemblies are manufactured with a variety of aperture sizes. For example, screen assemblies can be manufactured to filter coarse (large) particles, medium particles, or fine (small) particles. As such, many different screen assemblies must be kept on hand having varying diameters and filtering capabilities.

What is needed, therefore, are improved systems and methods for filtering particles from oil or gas entering a perforated base pipe.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Systems and methods for preventing particles from flowing into a base pipe are provided. A base pipe can have a plurality of perforations formed radially therethrough. A filtering strip can be wrapped helically around an outer surface of the base pipe to cover at least a portion of the perforations. The filtering strip can include a drainage layer, a filter layer, and a shroud layer. The drainage layer can include a plurality of ribs in contact with the outer surface of the base pipe. The filter layer can be coupled to the drainage layer and include at least one mesh screen. The shroud layer can be coupled to the filter layer and include a perforated metal sheet.

In another aspect, the method can include wrapping a filtering strip helically around an outer surface of a perforated base pipe. The strip can include a drainage layer, a filter layer, and a shroud layer. The drainage layer can include a plurality of ribs. The filter layer can be coupled to the drainage layer and include at least one mesh screen. The shroud layer can be coupled to the filter layer and include a perforated metal sheet. The base pipe having the filtering strip wrapped thereabout can be run into a wellbore.

BRIEF DESCRIPTION OF THE DRAWINGS

So that the recited features can be understood in detail, a more particular description, briefly summarized above, can be had by reference to one or more embodiments, some of which are illustrated in the appended drawings. It is to be noted, however, that the appended drawings illustrate only typical embodiments and are therefore not to be considered limiting of its scope, for the invention can admit to other equally effective embodiments.

FIG. 1 depicts a side view of a base pipe having an illustrative filtering strip wrapped thereabout, according to one or more embodiments described.

FIG. 2 depicts the base pipe and filtering strip of FIG. 1 disposed in a wellbore, according to one or more embodiments described.

FIG. 3 depicts perspective view of the filtering strip shown in FIG. 1, according to one or more embodiments described.

FIG. 4 depicts a partial cross-sectional view of the base pipe and filtering strip shown in FIG. 1, according to one or more embodiments described.

FIG. 5 depicts a perspective view of a base pipe having an illustrative filtering assembly disposed thereabout, according to one or more embodiments described.

FIG. 6 depicts a partial cross-sectional view of a drainage layer of the filtering assembly, according to one or more embodiments described.

DETAILED DESCRIPTION

Figure 7:
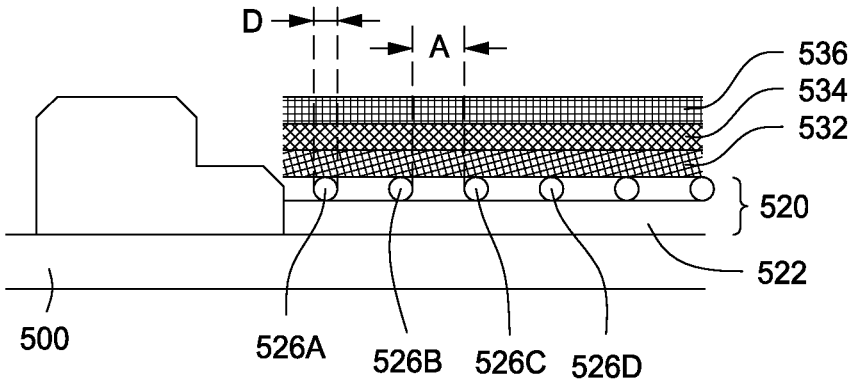
FIG. 7 depicts a cross-sectional side view of the drainage layer and a filter layer disposed thereabout, according to one or more embodiments.

FIG. 1 depicts a side view of a base pipe 100 having an illustrative filtering strip 110 wrapped thereabout, and FIG. 2 depicts the base pipe 100 and filtering strip 110 disposed in a wellbore 150, according to one or more embodiments. The base pipe 100 can be a hollow tubular member having a plurality of openings or perforations 102 (see FIG. 4) formed radially therethrough. The base pipe 100 can be adapted to be coupled to a workstring 152 and run into the wellbore 150. When disposed in the wellbore 150, fluid, such as hydrocarbons, can flow from a subterranean reservoir 154 into the workstring 152 via the perforations and then up to the surface 156.

The filtering strip 110 can be wrapped around an outer surface of the base pipe 100 such that it covers at least a portion of the perforations 102 in the base pipe 100. In at least one embodiment, the perforations 102 can be circumferentially and/or axially offset from one another on the base pipe 100. For example, the perforations 102 can be arranged in a helical manner in the base pipe 100. The strip 110 can be wrapped around the base pipe 100 to cover the perforations 102; yet, a gap G can exist between adjacent wraps 112A-D in the strip 110. In other words, no perforations 102 can be disposed in the sections of the base pipe 100 where the gaps G are disposed between the wraps 112A-D. Therefore, the strip 110 can cover the perforations 102 in the base pipe 100 without covering the entire outer surface of the base pipe 100, thereby reducing the amount of filtering material required. However, as may be appreciated, the strip 110 can also be wrapped around the base pipe 100 such that the wraps 112A-D at least partially overlap one another, and no gaps G exist.

In at least one embodiment, the strip 110 can be wrapped helically around the outer surface of the base pipe 100 (as shown). The width W of the strip 110 can range from a low of about 1 cm, about 2 cm, about 3 cm, about 4 cm, or about 5 cm to a high of about 10 cm, about 15 cm, about 20 cm, about 30 cm, about 40 cm, about 50 cm, or more. For example, the width W of the strip 110 can be between about 2 cm and about 5 cm, about 2 cm and about 10 cm, about 6 cm and about 10 cm, or about 2 cm and about 30 cm.

A pitch P of the strip 110 can be varied to control the amount of overlap between adjacent wraps 112A-D of the strip 110 and/or control the size of the gap G between adjacent wraps 112A-D of the strip 110. The pitch P of the strip 110 can range from a low of about 2 cm, about 3 cm, about 4, cm, or about 5 cm to a high of about 10 cm, about 15 cm, about 20 cm, about 30 cm, about 40 cm, about 50 cm, about 60 cm, or more. For example, the pitch P of the strip 110 can be between about 2 cm and about 5 cm, about 2 cm and about 10 cm, about 5 cm and about 10 cm, about 5 cm and about 20 cm, about 10 cm and about 20 cm, about 20 cm and about 30 cm, about 30 cm and about 60 cm or about 3 cm and about 60 cm. In at least one embodiment, a ratio of (W)/(W+P) can range from a low of about 0.05, about 0.1, about 0.2, about 0.3, about 0.4, or about 0.5, to a high of about 0.6, about 0.7, about 0.7, about 0.9, or about 1.0.

The gap G between adjacent wraps 112A-D can range from a low of about 1 cm, about 2 cm, about 3, cm, or about 4 cm to a high of about 5 cm, about 10 cm, about 15 cm, about 20 cm or more. For example, the gap G can be between about 1 cm and about 5 cm, about 1 cm and about 10 cm, about 5 cm and about 10 cm, about 10 cm and about 20 cm, about 20 cm and about 30 cm, or about 1 cm and about 30 cm.

In another embodiment, multiple strips 110 can form rings that are perpendicular with respect to a longitudinal axis through the center of the base pipe 100 (not shown). In this embodiment, the rings of strip 110 can be axially-offset from one another along the base pipe 100. The rings of strip 110 can be at least partially overlapping, or the rings of strip 110 can have a gap G disposed therebetween.

The strip 110 can be coupled to the base pipe 100 in any manner known in the art. For example, strip 110 can be welded to the base pipe 100, fastened to the base pipe 100 with end rings, or the like. The base pipe 100 can have a diameter ranging from a low of about 1" (2.54 cm), about 2" (5.08 cm), or about 3" (7.62 cm) to a high of about 6" (15.24 cm), about 8" (20.32 cm), about 10" (25.4 cm), or more. For example, the base pipe 100 can have a diameter of about 2.375" (6.03 cm), 2.875" (7.30 cm), about 3.5" (8.89 cm), about 4" (10.06 cm), about 4.5" (11.43 cm), about 5" (12.7 cm), about 5.5" (13.97 cm), or about 6.625" (16.83 cm). As may be appreciated, however, the strip 110 can be adapted to wrap around a base pipe 100 having any diameter. The length of the strip 110 can be varied by splicing together two or more strips 110 or terminating the strip 110 at the desired end point. The strip 110 can serve to increase or enhance the collapse rating of the base pipe 100.

FIG. 3 depicts perspective view of the filtering strip 110, according to one or more embodiments. The strip 110 can include one or more layers (three are shown 120, 130, 140). For example, the strip 110 can include a drainage layer 120, a filter layer 130, and a shroud layer 140.

The drainage layer 120 can include a first sub layer having a plurality of axial rods or ribs (also known as rib wire) 122 extending through the length L of the strip 110. When the strip 110 is wrapped around the base pipe 100, the ribs 122 can be in contact with the outer surface of the base pipe 100. In at least one embodiment, the ribs 122 do not filter sand and other particulates the fluid flowing through the strip 110. Rather, the ribs 122 can be offset from one another such that a channel 124 is formed between each two ribs 122. The channel 124 can provide a flow path between the base pipe 100 and the filter layer 130.

The drainage layer 120 can further include a second sub layer having a plurality of transverse wires 126 coupled to the ribs 122. As shown, the transverse wires 126 extend through the width W of the strip 110, and are thus perpendicular to the ribs 122. The transverse wires 126 can welded to the ribs 122 to hold the ribs 122 in place.

The filter layer 130 can be coupled to the drainage layer 120. In at least one embodiment, the filter layer 130 can include one or more sub layers of mesh screen (three are shown 132, 134, 136) that are diffusion bonded or sintered together; however, as may be appreciated, the sub layers 132, 134, 136 can be unsintered as well. For example, the number of sub layers of mesh screen in the filter layer 130 can range from a low of 1, 2, or 3 to a high of 6, 8, or 10. The mesh screens 132, 134, 136 can be formed by a square weave, a Dutch weave, a reverse Dutch weave, or any other method of weaving or braiding wire strands to form a pattern of apertures that are used to exclude or retain particles. The nominal average cross-sectional length, i.e., diameter, of the apertures in the mesh screens 132, 134, 136 can range from a low of about 40 μm, about 60 μm, about 80 μm, or about 100 μm to a high of about 200 μm, about 400 μm, about 600 μm, about 800 μm, about 1,000 μm, or more.

In at least one embodiment, the nominal average cross-sectional length of the apertures in the inner and outer mesh screens 132, 136 can range from a low of about 150 nm, about 200 μm, about 250 μm, about 300 μm, about 350 μm, or about 400 μm to a high of about 500 μm, about 600 μm, about 700 μm, about 800 μm, about 900 μm, about 1,000 μm, or more. For example, the nominal average cross-sectional length of the apertures in the inner and outer mesh screens 132, 136 can be between about 180 μm and about 1,000 μm, about 250 μm and about 800 μm, about 300 μm and about 600 μm, or about 400 μm and about 500 μm.

In at least one embodiment, the nominal average cross-sectional length of the apertures in the middle mesh screen 134 can range from a low of about 40 μm, about 60 μm, about 80 μm, about 100 μm, about 120 μm, about 140 μm, about 160 μm, or about 180 μm to a high of about 200 μm, about 220 μm, about 240 μm, about 260 μm, about 280 μm, about 300 μm, or more. For example, the nominal average cross-sectional length of the apertures in the middle mesh screen 134 can be between about 60 μm and about 300 μm, about 80 μm and about 250 μm, about 100 μm and about 200 μm, or about 120 μm and about 180 μm.

The shroud layer 140 can be coupled to the filter layer 130. The shroud layer 140 can be a metal sheet having a plurality of openings, slots, or perforations 142 formed therethrough. The shroud layer 140 can be, for example, a sheet of stainless steel having a thickness ranging from a low of about 1.0 mm, about 1.5 mm, or about 2.0 mm to a high of about 3.0 mm, about 3.5 mm, or about 4.0 mm. In at least one embodiment, the perforations 142 can have a nominal average cross-sectional length, i.e., diameter, ranging from a low of about 1 mm, about 2 mm, about 3 mm, about 4 mm, or about 5 mm to a high of about 10 mm, about 12 mm, about 14 mm, about 16 mm, about 18 mm, or more. For example, the nominal average cross-sectional length of the perforations 142 can be between about 3 mm and about 13 mm. In at least one embodiment, the perforations 142 are not adapted to filter; rather, the perforations 142 can be sized to allow sand and other particulates to flow therethrough.

In at least one embodiment, one or more side walls (one is shown 144) can be coupled to the sides of the strip 100 and adapted to hold the layers 120, 130, 140 together. The side walls 144 can extend along the length L of the strip 110 and from the bottom of the drainage layer 120 to the top of the shroud layer 140. The side walls 144 can be structurally-connected (e.g., welded) to the drainage layer 120 and the shroud layer 140. In at least one embodiment, the side walls can be stainless steel.

FIG. 4 depicts a partial cross-sectional view of the filtering strip 110 wrapped around the base pipe 100, according to one or more embodiments. As mentioned above, the base pipe 100 can include a plurality of perforations 102 formed radially therethrough. The strip 110 can be wrapped around the base pipe 100 to cover at least a portion of the perforations 102. The drainage layer 120 of the strip 110 can be coupled to and disposed radially-outward from the base pipe 100. The filtering layer 130 can be coupled to and disposed radially-outward from the drainage layer 120. The shroud layer 140 can be coupled to and disposed radially-outward from the filtering layer 130.

Now referring to FIGS. 1-4, the strip 110 can be disposed on a spool (not shown) with concentric layers wrapped thereabout. In operation, the strip 110 can be peeled from the spool and wrapped around the outer surface of the perforated base pipe 100. In at least one embodiment, the strip 110 can be wrapped helically around the outer surface of the base pipe 100 to cover at least a portion (or all) of the perforations 102. While wrapping, the pitch P of the strip 110 can be varied to control the amount of overlap between adjacent wraps 112A-D of the strip 110 and/or control the size of the gap G between adjacent wraps 112A-D of the strip 110. Thus, in at least one embodiment, the outer surface of the base pipe 100 can be completely covered by the strip 110; however, in other embodiments, the outer surface of the pipe 100 can be only partially covered with gaps G disposed between the adjacent wraps 112A-D of the strip 110. Once the strip 110 is wrapped around the base pipe 100 and the desired pitch is achieved, the strip 110 can be welded, e.g., resistance welded, to the base pipe 100.

The base pipe 100 can then be coupled to the workstring 152 and run into the wellbore 150. Hydrocarbons from a subterranean reservoir 154 can flow from the reservoir 154, through the strip 110, and into the base pipe 100. More particularly, the hydrocarbons can flow through the shroud layer 140, the filter layer 130 where sand and other particulates can be separated therefrom, and the drainage layer 120. The filtered hydrocarbons can then flow through the perforations 102 in the base pipe 100, and up the workstring 152 to the surface 156. The filter layer 130 in the strip 110 can be adapted to prevent particles, e.g., sand, having a nominal average cross-sectional length greater than a predetermined amount from passing therethrough and into the workstring 152. In other words, the size of the particles allowed to flow through the strip 110 can be dependent upon the aperture size selected for the filter layer 130.

In an alternative embodiment, FIG. 5 depicts a perspective view of a base pipe 500 having an illustrative filtering assembly 510 disposed thereabout, according to one or more embodiments. The base pipe 500 can be a non-perforated hollow tubular member. The filtering assembly 510 can include a drainage layer 520 having a filtering layer 530 coupled to and disposed radially-outward therefrom.

The drainage layer 520 can be coupled to and disposed radially-outward from the base pipe 500. The drainage layer 520 can include a first sub layer having a plurality of axial rods or ribs (also known as rib wire) 522 in contact with the outer surface of the base pipe 500 and extending longitudinally therealong. In other words, the ribs 522 can be parallel to, and radially-outward from, a centerline extending through the base pipe 500. The drainage layer 520 can also include a second sub layer including a wrap wire 526. The wrap wire 526 can be coupled to and disposed radially-outward from the ribs 522 to hold the ribs 522 in place on the base pipe 500. The wrap wire 526 can be generally transverse to the ribs 522. The wrap wire 526 can be welded to the ribs 522 at the intersection points with a direct wrap screen manufacturing process. A filter layer 530 can be coupled to and disposed radially-outward from the drainage layer 520. The filter layer 530 can be adapted to prevent particles, such as sand or fines, from flowing therethrough. In at least one embodiment, a perforated shroud 540 can be coupled to and disposed radially-outward from the filtering layer 530.

FIG. 6 depicts a partial cross-sectional view of the drainage layer 520, according to one or more embodiments. The ribs 522 can have a cross-sectional shape that is triangular, circular, square, rectangular, pentagonal, hexagonal, or the like. As shown in FIG. 6, the ribs 522 have a triangular cross-sectional shape. As such, the ribs 522 can have a base B and a height H. The base B of the ribs 522 can be in direct contact with the outer surface of the base pipe 500, and the height H can extend radially-outward from the outer surface of the base pipe 500.

The base B of the ribs 522 can range from a low of about 1 mm, about 1.5 mm, about 2 mm, about 2.5 mm, or about 3 mm to a high of about 3.5 mm, about 4 mm, about 4.5 mm, about 5 mm, about 6 mm, about 8 mm, about 10 mm, or more. For example, the base B can be between about 1 mm and about 5 mm, about 2 mm and about 4 mm, or about 2.5 mm and about 3.5 mm. The height H of the ribs 522 can range from a low of about 1 mm, about 1.5 mm, about 2 mm, about 2.5 mm, or about 3 mm to a high of about 3.5 mm, about 4 mm, about 4.5 mm, about 5 mm, about 5.5 mm, about 6 mm, about 8 mm, about 10 mm, or more. For example, the height H can be between about 2 mm and about 6 mm, about 3 mm and about 5 mm, or about 3.5 mm and about 4.5 mm.

The ribs 522 can be circumferentially-offset from one another such that a channel 524 is disposed between each two ribs 522. Thus, each channel 524 can be defined by two ribs 522 on either side, the base pipe 500 (at the radially-inner extent), and the wrap wire 526 (at the radially-outer extent). The channels 524 can be adapted to have a fluid flow therethrough to an inflow control device (not shown). This combination of ribs 522 and wrap wire 526 can provide a very robust drainage layer 520, with optimal area open to flow along the direction of the ribs 522 via the channels 524. Further, the triangular ribs 522 can provide a substantially more open area of flow between the base pipe 500 and the filter layer 530 than a conventional round rib.

FIG. 7 depicts a cross-sectional side view of the drainage layer 520 and the filter layer 530 disposed thereabout, according to one or more embodiments. In at least one embodiment, the wrap wire 526 of the drainage layer 520 can have a cross-sectional shape that is triangular, circular, square, rectangular, pentagonal, hexagonal, or the like. As shown, the wrap wire 526 has a round cross-sectional shape. The wrap wire 526 can have a nominal average cross-sectional length, i.e., diameter D, ranging from a low of about 1.5 mm, about 1.6 mm, about 1.7 mm, about 1.8 mm, about 1.9 mm, or about 2.0 mm to a high of about 2.1 mm, about 2.2 mm, about 2.3 mm, about 2.4 mm, about 2.5 mm, or more. For example, the wrap wire 526 can have a diameter D between about 1.7 mm and about 2.3 mm, about 1.8 mm and about 2.2 mm, or about 1.9 mm and about 2.1 mm.

The wrap wire 526 can be wrapped helically around the base pipe 500 and ribs 522 such that a gap A can exist between adjacent wraps 526A-D of the wrap wire 526. In at least one embodiment, the gap A of the wrap wire 526 can allow sand and other particulates to flow therethrough, i.e., the wrap wire 526 may not filter hydrocarbons flowing therethrough. The gap A of the wrap wire 526 can be less than the diameter D of the wrap wire 526. In at least one embodiment, the gap A of the wrap wire 526 can range from a low of about 0.7 mm, about 0.8 mm, about 0.9 mm, about 1.0 mm, about 1.1 mm, or about 1.2 mm to a high of about 1.3 mm, about 1.4 mm, about 1.5 mm, about 1.6 mm, about 1.7 mm, about 1.8 mm, about 1.9 mm, or about 2.0 mm. For example, the gap A of the wrap wire 526 can be between about 1.0 mm and about 1.6 mm, about 1.1 mm and about 1.5 mm, or about 1.2 mm and about 1.4 mm. Such a gap A to diameter D ratio enables the wrap wire 526 to provide substantial support for the overlying filter layer 530.

The filter layer 530 can be coupled to and disposed radially-outward from the drainage layer 520. In at least one embodiment, the filter layer 530 can include one or more sub layers of mesh screen (three are shown 532, 534, 536) that are sintered together; however, as may be appreciated, the layers 532, 534, 536 can be unsintered as well. For example, the number of sub layers of mesh screen in the filter layer 530 can range from a low of about 1, about 2, or about 3 to a high of about 6, about 8, or about 10. The mesh screens 532, 534, 536 can be formed by a square weave, a Dutch weave, a reverse Dutch weave, or any other method of weaving or braiding wire strands to form a pattern of apertures that are used to exclude or retain particles. Alternatively, the filter layer 530 can be another layer of wrap wire (not shown).

The first ("inner") layer 532 can be in contact with and disposed radially-outward from the wrap wire 526. The second ("middle") layer 534 can be disposed radially-outward from the inner layer 532. The third ("outer") layer 536 can be disposed radially-outward from the middle layer 534. The nominal average cross-sectional length, i.e., diameter, of the apertures in the mesh screens 532, 534, 536 can range from a low of about 40 μm, about 60 μm, about 80 μm, or about 100 μm to a high of about 200 μm, about 400 μm, about 600 μm, about 800 μm, about 1,000 μm, or more.

The inner and outer mesh layers 532, 536 can have aperture sizes that are adapted to allow sand to pass therethrough. The aperture sizes of the inner and outer mesh layers 532, 536 can range from 2 to 5 times greater than the aperture sizes of the middle mesh layer 434, or from about 3 to 4 times greater than the aperture sizes of the middle mesh layer 534 to provide protection and standoff of the middle mesh layer 534. In at least one embodiment, the nominal average cross-sectional length of the apertures in the inner and outer mesh screens 532, 536 can range from a low of about 150 μm, about 200 μm, about 250 μm, about 300 μm, about 350 μm, or about 400 μm to a high of about 500 μm, about 600 μm, about 700 μm, about 800 μm, about 900 μm, about 1,000 μm, or more. For example, the nominal average cross-sectional length of the apertures in the inner and outer mesh screens 532, 536 can be between about 180 μm and about 1,000 μm, about 250 μm and about 800 μm, about 300 μm and about 600 μm, or about 400 μm and about 500 μm.

The middle mesh layer 534 can have aperture sizes that are smaller than the aperture sizes in the inner and outer mesh layers 532, 536. The middle mesh layer 534 can have aperture sizes that are adapted to filter sand, i.e., prevent sand from passing therethrough. In at least one embodiment, the nominal average cross-sectional length of the apertures in the middle mesh screen 534 can range from a low of about 40 μm, about 60 μm, about 80 μm, about 100 μm, about 120 μm, about 140 μm, about 160 μm, or about 180 μm to a high of about 200 μm, about 220 μm, about 240 μm, about 260 μm, about 280 μm, about 300 μm, or more. For example, the nominal average cross-sectional length of the apertures in the middle mesh screen 534 can be between about 60 μm and about 300 μm, about 80 μm and about 250 μm, about 100 μm and about 200 μm, or about 120 μm and about 180 μm.

The gap A of the wrap wire 526 can be greater, i.e., wider, than the aperture size of the filter layer 530 and/or the middle mesh layer 534. For example, the ratio between the gap A of the wrap wire 526 and the aperture size of the middle mesh layer 534 can be greater than about 2:1, greater than about 2.5:1, greater than about 3:1, greater than about 3.5:1, greater than about 4:1, greater than about 4.5:1, or greater than about 5:1. As such, the gap A of the wrap wire 526 can be less than the diameter D of the wrap wire 526, yet greater than about three times the aperture opening of the middle mesh layer 534 to prevent plugging. The size of the gap A can prevent sand or fines passing through the filter layer 530 from bridging and/or plugging the gap A. Rather, the gap A can be sized to allow the sand or fines passing though the filter layer 530 to pass through the gap A.

Figure 8:
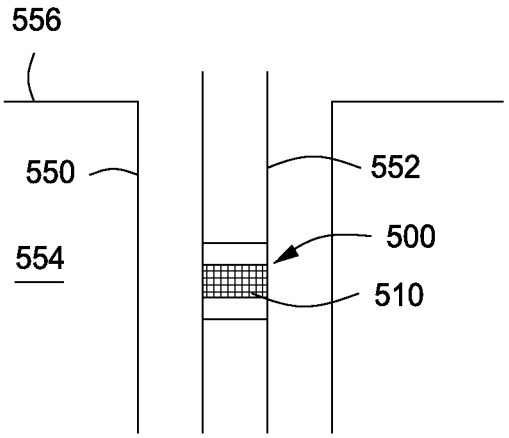
FIG. 8 depicts the base pipe and filtering assembly disposed in a wellbore, according to one or more embodiments

FIG. 8 depicts the base pipe 500 and filtering assembly 510 disposed in a wellbore 550, according to one or more embodiments. Referring now to FIGS. 5-8, in operation, the ribs 522 can be placed longitudinally on the outer surface of the base pipe 500. More particularly, the base B of the triangular ribs 522 can be placed in direct contact with the outer surface of the base pipe 500. The wrap wire 526 can then be wrapped helically around the ribs 522 to hold the ribs 522 in place on the base pipe 500. Directly wrapping the ribs 522 and the wrap wire 526 on the base pipe 500 can reduce the slippage of the drainage layer 520 on the base pipe 500, provide minimal or zero manufacturing and assembly tolerances between the inner drainage layer 520 and the base pipe 500, which leads to a smaller overall product outside diameter, and improve the resistance of the drainage layer 520 to collapse.

Once the drainage layer 520 is disposed on the base pipe 500, the filter layer 530 can be placed around the drainage layer 520. The filter layer 530 can be a tubular sleeve that can slide over the drainage layer 520. In at least one embodiment, a perforated shroud (not shown) can be disposed around the filter layer 530 to protect the filter layer 530.

The base pipe 500 can then be coupled to a workstring 552 and run into a wellbore 550. Hydrocarbons can flow through filter layer 530 and into the channels 524 of the drainage layer 520. The hydrocarbons can flow axially through the channels 524 to a nozzle (not shown) in an inflow control device (not shown) in the base pipe 500. The hydrocarbons can flow through the nozzle and to an interior of the base pipe 500 and then up to the surface 556.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A downhole tool, comprising:

a base pipe having a plurality of perforations formed radially therethrough; and a filtering strip wrapped helically around an outer surface of the base pipe to cover at least a portion of the perforations, the filtering strip comprising:

a drainage layer comprising a plurality of ribs in contact with the outer surface of the base pipe;

a filter layer positioned adjacent to the drainage layer, wherein the filter layer comprises at least one mesh screen; and a shroud layer positioned adjacent to the filter layer, wherein the shroud layer comprises a perforated metal sheet, wherein the drainage layer and the shroud layer are structurally connected to one another prior to being wrapped around the base pipe, and wherein the drainage layer, the filter layer, and the shroud layer are wrapped simultaneously around the base pipe.

2. The tool of claim 1, wherein the drainage layer further comprises a plurality of transverse wires that are perpendicular to the ribs.

3. The tool of claim 1, wherein a width of the strip is between about 2 cm and about 30 cm.

4. The tool of claim 1, wherein the strip is wrapped around the base pipe such that adjacent wraps of the strip at least partially overlap one another.

5. The tool of claim 1, wherein the strip is wrapped around the base pipe such that a longitudinal gap is disposed between two adjacent wraps of the strip.

6. The tool of claim 5, wherein a width of the gap is between about 1 cm and about 30 cm.

7. The tool of claim 5, wherein a pitch of the strip wrapped around the base pipe is between about 3 cm and about 60 cm.

8. The tool of claim 1, wherein the strip covers all of the perforations in the base pipe.

9. The tool of claim 1, wherein the drainage layer, the filter layer, and the shroud layer each have substantially the same width.

10. The tool of claim 1, wherein the drainage layer, the filter layer, and the shroud layer are physically connected to one another with a connecting member.

11. The tool of claim 10, wherein the connecting member is a side wall physically connected to sides of the drainage layer and the shroud layer.

12. The tool of claim 1, wherein the drainage layer and the shroud layer are structurally connected to one another by welding prior to being wrapped around the base pipe.

13. A downhole tool, comprising:

a base pipe having a plurality of perforations formed radially therethrough; and a filtering strip wrapped helically around an outer surface of the base pipe to cover at least a portion of the perforations, the filtering strip comprising:

a drainage layer comprising:

a plurality of ribs in contact with the outer surface of the base pipe; and a plurality of transverse wires that are perpendicular to the ribs;

a filter layer positioned adjacent to the drainage layer, wherein the filter layer comprises:

an inner mesh screen positioned adjacent to the drainage layer;

an outer mesh screen, wherein the inner and outer mesh screens each include a first plurality of apertures having a nominal average cross-sectional length between about 300 μm and about 1,000 μm; and a middle mesh screen disposed between the inner and outer mesh screens, wherein the middle mesh screen includes a second plurality of apertures having a nominal average cross-sectional length between about 60 μm and about 300 μm; and a shroud layer positioned adjacent to the filter layer, wherein the shroud layer comprises a metal sheet having a plurality of openings formed therethrough with a nominal average cross-sectional length between about 3 mm and about 13 mm, wherein the drainage layer and the shroud layer are structurally connected to one another prior to being wrapped around the base pipe, and wherein the drainage layer, the filter layer, and the shroud layer are wrapped simultaneously around the base pipe.

14. The tool of claim 13, wherein the plurality of ribs comprises a first sub layer and the plurality of transverse wires comprises a second sub layer, and wherein the first and second sub layers are welded together.

15. The tool of claim 13, wherein a channel is formed between each two ribs of the plurality of ribs.

16. The tool of claim 13, further comprising a side wall structurally connected to a side of the strip and adapted to hold the drainage layer, the filter layer, and the shroud layer together.

17. The tool of claim 16, wherein the side wall is made of stainless steel.

18. The tool of claim 16, wherein the side wall is welded to the drainage layer and the shroud layer.

19. The tool of claim 13, wherein the inner mesh screen is sintered to the middle mesh screen.

20. A method of preventing particles from flowing into a base pipe, comprising:

wrapping a filtering strip helically around an outer surface of a perforated base pipe, wherein the strip comprises:

a drainage layer comprising a plurality of ribs;

a filter layer positioned adjacent to the drainage layer, wherein the filter layer comprises at least one mesh screen; and a shroud layer positioned adjacent to the filter layer, wherein the shroud layer comprises a perforated metal sheet, wherein the drainage layer and the shroud layer are structurally connected to one another prior to being wrapped around the base pipe, and wherein the drainage layer, the filter layer, and the shroud layer are wrapped simultaneously around the base pipe; and running the base pipe having the strip wrapped thereabout into a wellbore.

21. The method of claim 20, further comprising varying a pitch of the strip to make two adjacent wraps of the strip at least partially overlap one another.

22. The method of claim 20, further comprising varying a pitch of the strip to vary a gap disposed between two adjacent wraps of the strip.

23. The method of claim 20, further comprising welding the strip to the base pipe.

24. The method of claim 20, further comprising covering at least a portion of the perforations in the base pipe with the strip.

* * * * *